United States Patent [19]

King

[11] 4,130,916

[45] Dec. 26, 1978

[54] BELT HOOK AND METHOD OF MAKING SAME

[76] Inventor: Terence P. King, 76 S. Main St., Middleboro, Mass. 02346

[21] Appl. No.: 828,474

[22] Filed: Aug. 29, 1977

[51] Int. Cl.[2] ..... A44B 11/22

[52] U.S. Cl. ..... 24/186; 403/265

[58] Field of Search ..... 24/176, 186, 77 R; 403/267, 269, 265, 268

[56] References Cited

U.S. PATENT DOCUMENTS

| | | | |
|---|---|---|---|
| 1,411,229 | 3/1922 | Thomas | 403/265 |
| 2,419,662 | 4/1947 | Sutton | 24/186 |
| 3,777,315 | 12/1973 | Norfolk | 24/77 R |

*Primary Examiner*—Kenneth J. Dorner

[57] ABSTRACT

A belt hook construction is provided for use with a buckle member of the class having a belt plate in which a belt hook is secured by the use of cast metal. An essential requirement is that the belt hook be held in a forwardly extended position without turning or tilting when subjected to pulling and twisting forces. Such forces develop in the wear of a belt of this class in a tightened position of adjustment. To prevent displacement by such forces, the belt hook of the invention is formed with a casting end having special anchoring means formed therein. The anchoring means are designed to project into solidified casting metal located therearound and to oppose forces acting to twist, tilt, or otherwise displace the hook from its secured position in the belt plate. The anchoring means includes ridges or rib formations arranged in angularly disposed relation to one another so as to provide greatly increased resistance to twisting and tilting forces. The invention further includes a novel method of forming a belt hook with the anchoring means described.

3 Claims, 11 Drawing Figures

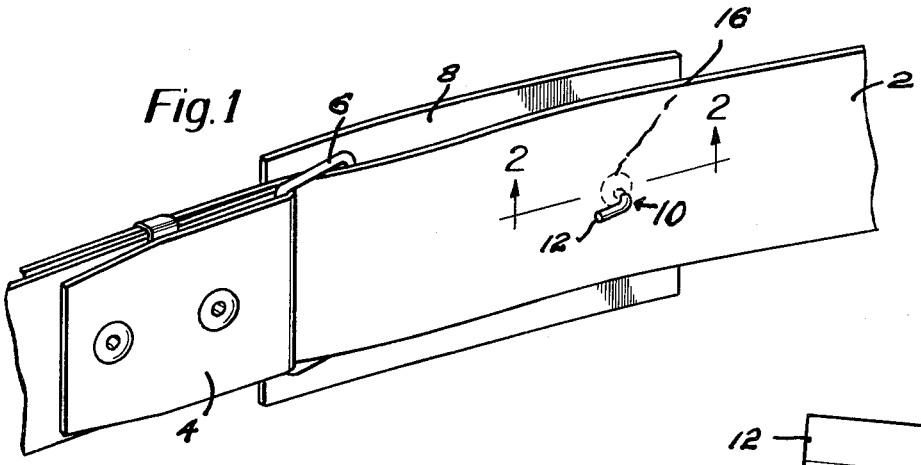
Fig. 1
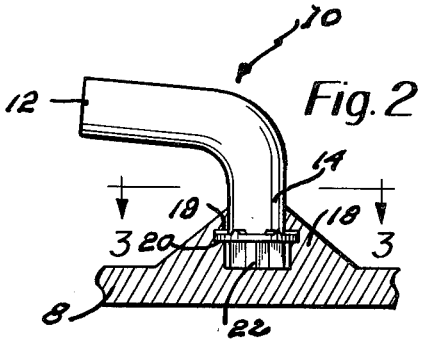
Fig. 2
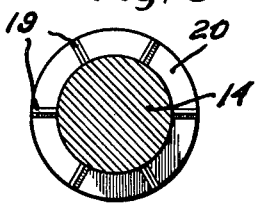
Fig. 3
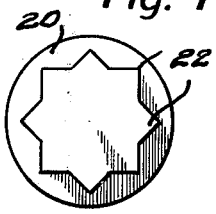
Fig. 4
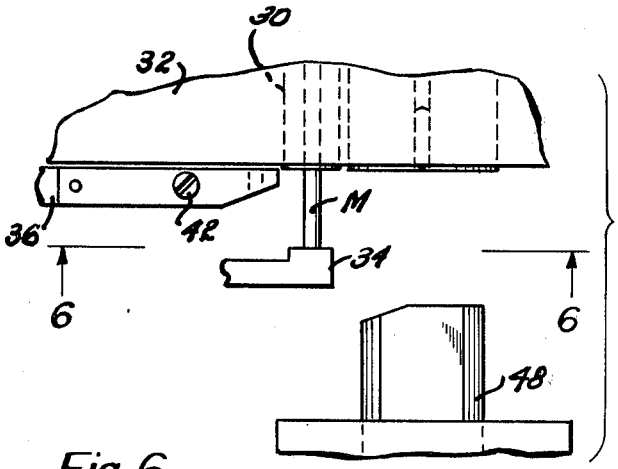
Fig. 5
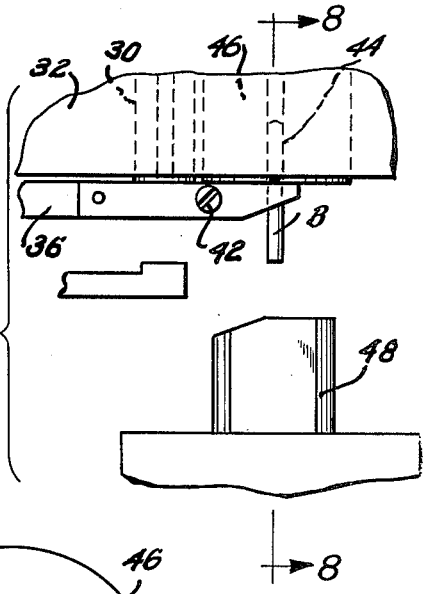
Fig. 7
Fig. 6
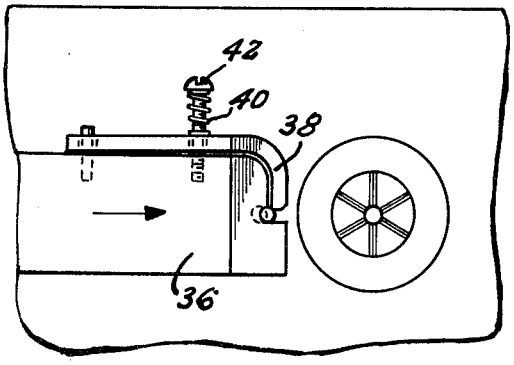
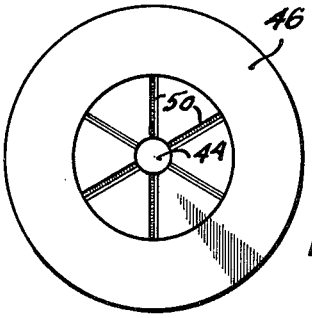
Fig. 6A

BELT HOOK AND METHOD OF MAKING SAME

BACKGROUND OF INVENTION

In the art of fastening devices of the buckle class, it is well known to provide a belt buckle which can be readily attached to a belt member and detachably engaged with one or more perforations in the belt to provide for the belt being worn in a desirably tightened position of adjustment.

In addition to conventional buckles having a pivoting tongue for engagement with a belt perforation, it has also been proposed to construct a belt buckle in the form of a frame or plate at the inner side of which is secured a belt hook element. The belt hook engaged through perforations in a belt allows a belt to be tightened around a wearer's waist and worn with the hook member being concealed from view.

A buckle and belt assembly of the type indicated is disclosed in U.S. Pat. No. 941,702, issued Nov. 30, 1909. More recently there has been increasing manufacture and sale of buckles of the belt plate class with which separately formed hook elements are secured in casting wells in the plate by solidified casting metal. Although such a mode of attachment is relatively cheap and convenient to carry out, difficulty is experienced from displacement of the belt hook when subjected to the pulling and twisting forces exerted through a belt when worn in a tightened position of adjustment. If the hook is turned or tilted out of its normal holding position it tends to become easily disengaged from the belt and fails to provide a proper holding action.

SUMMARY OF THE INVENTION

The present invention relates to belt buckles and is concerned with a buckle structure of the class in which a belt plate is formed with a casting well and a belt hook member is separately constructed and secured in the casting well by solidified casting metal.

It is in general an object of the invention to provide an improved belt hook construction. Another object of the invention is to devise a belt hook element which can be constructed with anchoring means formed at one end of the hook for extending into solidified casting metal in a position to rigidly resist displacement. Another object of the invention is to devise a belt hook with a casting end having anchoring ridge portions arranged to extend in angularly disposed relation to one another. Still another object of the invention is to provide an improved method of forming a belt hook with multiple anchoring means.

The invention and its other objects and novel features will be more fully understood from the detailed description of the structure shown in the accompanying drawings.

DESCRIPTION OF THE DRAWINGS

FIG. 1 is a fragmentary perspective view of a belt and belt buckle assembly of the belt plate class and illustrates the belt hook construction of the invention in an operative position.

FIG. 2 is a detailed cross section taken on the line 2—2 of FIG. 1.

FIG. 3 is a cross section taken on the line of 3—3 of FIG. 2.

FIG. 4 is a detailed plan view of the knurled end of the belt hook illustrated in FIGS. 1-3.

FIG. 5 is a fragmentary plan view of cutting and forming apparatus employed in carrying out the method of the invention and there is also illustrated a length of belt hook material shown in a position to be cut.

FIG. 6 is a view taken on the line 6—6 of FIG. 5 further illustrating the cutting and forming die of FIG. 5.

FIG. 6A is an enlarged detail view illustrating grooves in the face of the die shown in FIG. 6.

FIG. 7 is a plan view of the apparatus shown in the FIGS. 5 and 6 with the belt hook material having been cut off to form a blank and the blank moved into position to be entered into the face of the die member.

DETAILED DESCRIPTION OF THE INVENTION

Figure 8:
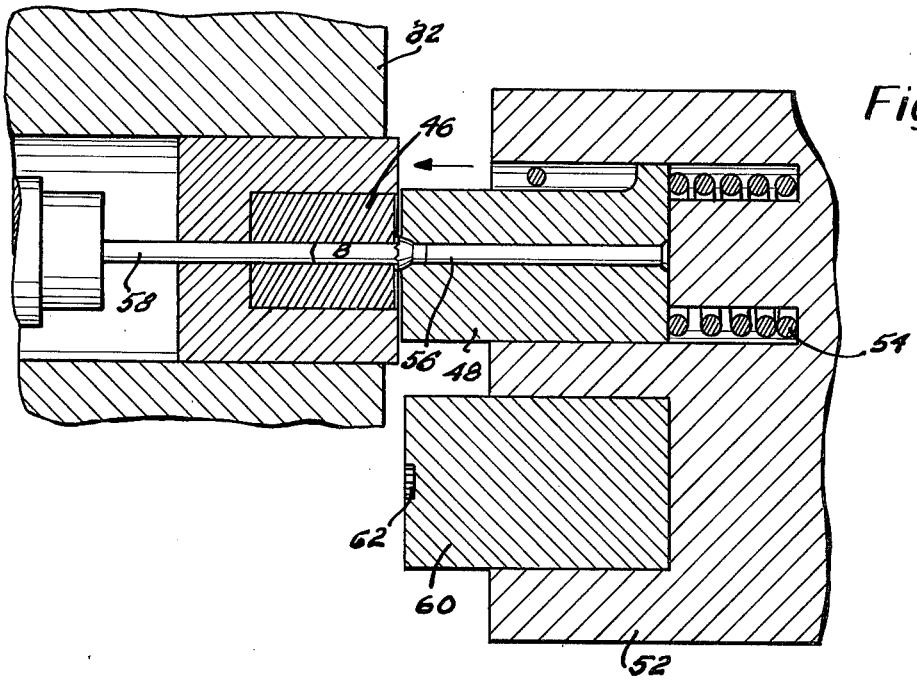
FIG. 8 is a cross section taken on the line 8—8 of FIG. 7 and further shows the blank having been moved into the forming die by means of a punch to carry out one forming operation.
Figure 9:
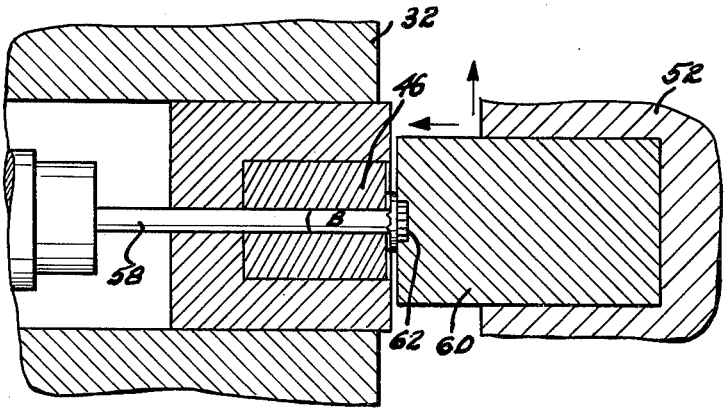
FIG. 9 is a cross sectional view of die and punch apparatus illustrating a second forming operation.
Figure 10:
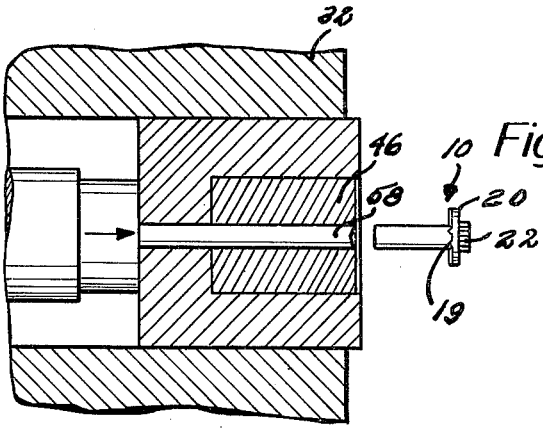
FIG. 10 is a cross sectional view of the apparatus with the finished belt hook element having been ejected by a knock-out pin.

Referring more in detail to the drawings, 2 denotes a belt member having a folded end and wrapped around a metal loop 6 which is pivotally attached to a belt plate 8. An opposite end of the belt 2 is shown passed through the loop and having a belt hook element engaged through a perforation in the belt in a forwardly extending position as shown in FIG. 1.

The belt hook element is generally denoted by the arrow 10 and includes a retaining end 12 and a casting end 14 which is specially constructed to be rigidly secured by casting metal in an opening or casting well 16 provided in the belt plate 8.

In FIG. 2, the casting metal is indicated diagrammatically at 18 and as will be noted it completely surrounds and overlies the extremity of the casting end 14.

In accordance with the invention, the casting end 14 is constructed with two sets of ridges which are separated by a flange portion and which extend outwardly into the casting metal 18 in a manner such that substantial resistance to displacement from twisting, tilting or pulling forces exerted through the belt 2 is realized, and the retaining end of hook 10 is maintained in the forwardly extending position shown in FIG. 1.

One of the sets of ridges consist in spaced apart radially extending portions denoted by 19 and these ridges are most clearly shown in FIGS. 2 and 3. As will be observed from these Figures, the ridges 19 project outwardly at an angle to the longitudinal axis of the casting end 14. These angularly projecting ridges are located at one side of and are integral with the flange body 20 as may be seen from an inspection of FIG. 2.

A second set of ridges or ribs in the form of knurling are located at an opposite side of the flange body 20 as indicated in FIG. 2. In FIG. 4, the ridges or knurling and one side of the flange body 20 are shown in end elevation. It is pointed out that these ridges 22 are arranged to extend in substantially parallel relationship to the longitudinal axis of the casting end 14 and it will be apparent that ridges of the first set indicated at 19 occur in angularly disposed relationship to ridges 22 of the second set.

By means of this dual set of ridges spaced apart by a flanged portion and occurring in angularly disposed relationship, there is provided a very substantial resistance to displacement of the casting end 14 in the belt plate 8 in any direction. Thus, the ridges 22 resist forces tending to rotate the belt hook 10. The flange 20 tends to resist pulling forces exerted on the belt hook and the combined effect of the flange and the angularly projecting ridges functions to resist twisting and tilting forces in a highly desirable manner. In use, the belt hook construction disclosed has been found to provide for the belt hooks retaining their position in the belt plate in a satisfactory manner.

In FIGS. 5–10 inclusive, there is illustrated one desirable method and apparatus for forming the above described belt hook construction. As shown in FIG. 5, a length of belt hook material M such as a steel rod or wire is received in a cut off die or quill member 30 mounted in a die holder body 32. A projecting end of the material M is located against a stock member 34 and a movable cut off knife 36 is supported on the die holder in a position to move into a location for cutting the material M and forming a blank B as illustrated in FIG. 7. At the upper side of the knife 36 is a spring clip 38 resiliently held by a spring 40 and screw 42. When the knife moves ahead and cuts off the blank B, this part is held in the knife by the spring clip 38 as illustrated in FIG. 6 so that the knife can carry the cut off blank into the next forming position.

The first step of cutting to form the blank B is followed by the step of positioning the blank B in alignment with a die aperture 44 in a die member 46 also received in the die holder 32. Extending outwardly from the die aperture 44 in the face of the die 46 are radial grooves 50, more clearly shown in FIG. 6A. Mounted for travel into contact with the blank B is a "coning" punch 48. This punch is further illustrated in FIG. 8 and as shown therein is supported by a punch holder 52 being resiliently received against a spring 54. A knockout pin 56 is located in the punch in a centrally disposed position. As shown in FIG. 8, the die 46 has received therein a knockout pin 58 against which the blank B engages when moved into die 46.

A third step in the invention method consists in moving the "coning" punch 48 against the blank B and causing portions of the blank to engage with the grooves 50 of the die 46 and partially form the flange portion 20 earlier described and at the same time there are formed ridges 19 as also noted above.

In a final step of the invention method, the punch 48 is withdrawn and the punch holder 52 advances to align a second punch 60 with the partially formed blank remaining in die 46. The second punch 60 is formed with a head forming cavity 62 having V-shaped grooves formed therein. When the punch 60 is activated, the end of the blank 50 is forced into the cavity and against the V-shaped grooves to provide a knurled end having projecting ridges which extend parallelly with the longitudinal axis of the belt hook element. Thereafter, the knockout pin 58 is traveled through the die 46 and the finished belt hook element 10 is ejected as suggested in FIG. 10.

The method described may be carried out rapidly and cheaply to provide a belt hook construction of highly satisfactory nature. In the installation of the belt hook, it will be understood that it is normally placed in a belt plate well in an upright position with casting metal being allowed to flow around the flange knurled edges and radiating edges. When the belt hook has been rigidly anchored by reason of the casting metal being solidified, the projecting end of the hook may then be bent into the forwardly extending position shown in FIG. 1.

I claim:

1. A belt hook construction for use with a belt plate of the class having at its inner side a casting well in which the belt hook may be received and secured by casting metal in a belt retaining position, said belt hook construction comprising an elongated body portion having a casting end and a retainer portion, said casting end being formed with a knurled extremity and an annular flange abutting the knurled extremity and projecting outwardly therefrom, an opposite side of the annular flange being formed with spaced apart radially disposed ridges.

2. The invention of claim 1 in which the knurled extremity presents spaced apart ridges which extend substantially parallel with a longitudinal axis of the casting rod, and the said radially disposed ridges extend outwardly at an angle to the said longitudinal axis of the casting end.

3. A belt hook construction for use in a belt plate comprising an elongated body having a retainer portion and a casting extremity to be secured by casting metal in an opening in the belt plate, means formed in the casting extremity for resisting displacement when surrounded by solidified casting metal, said means including ridges arranged to extend into the solidified casting metal in a position to oppose forces directed to rotating the belt hook about a longitudinal axis of said casting extremity, said ridges consisting of a set of ridges extending in substantially parallel relation to the longitudinal axis of the casting extremity, and additional ridges extending outwardly at an angle to the said longitudinal axis, and said parallel ridges and the angularly extending ridges being separated by an annular flange portion.

* * * * *